US011235912B2

(12) United States Patent
Defert et al.

(10) Patent No.: US 11,235,912 B2
(45) Date of Patent: Feb. 1, 2022

(54) PERFORATOR CAP, IN PARTICULAR FOR A FLEXIBLE TUBE

(71) Applicant: ALBEA SERVICES, Gennevilliers (FR)

(72) Inventors: Sylvain Defert, Saint Ouen l'Aumone (FR); Franck Fritsch, Deuil la Barre (FR)

(73) Assignee: ALBEA SERVICES, Gennevilliers (FR)

( * ) Notice: Subject to any disclaimer, the term of this patent is extended or adjusted under 35 U.S.C. 154(b) by 0 days.

(21) Appl. No.: 15/632,274

(22) Filed: Jun. 23, 2017

(65) Prior Publication Data

US 2017/0369210 A1 Dec. 28, 2017

(30) Foreign Application Priority Data

Jun. 23, 2016 (FR) ..... 1655898

(51) Int. Cl.

| | |
|---|---|
| ***B65D 35/44*** | (2006.01) |
| ***B65D 41/06*** | (2006.01) |
| ***B65D 51/22*** | (2006.01) |
| ***B65D 85/00*** | (2006.01) |

(52) U.S. Cl.

CPC ..... *B65D 35/44* (2013.01); *B65D 41/065* (2013.01); *B65D 51/225* (2013.01); *B65D 85/70* (2013.01); *B65D 85/00* (2013.01); *B65D 2251/0006* (2013.01); *B65D 2251/0093* (2013.01)

(58) Field of Classification Search

CPC ..... B65D 35/44; B65D 51/22; B65D 41/065; B65D 51/225; B65D 85/70; B65D 85/00; B65D 2251/0006; B65D 2251/0093

USPC ..... 215/252

See application file for complete search history.

(56) References Cited

U.S. PATENT DOCUMENTS

| | | | | |
|---|---|---|---|---|
| 3,344,942 | A | 10/1967 | Hedgewick | |
| 3,435,975 | A * | 4/1969 | Weigand | B65D 41/065 215/214 |
| 3,613,928 | A * | 10/1971 | Landen | B65D 41/065 215/214 |
| 3,734,331 | A * | 5/1973 | De Felice | B65D 41/06 215/217 |
| 3,809,276 | A * | 5/1974 | Landen | B65D 41/065 215/301 |
| 4,049,148 | A | 9/1977 | Suhr et al. | |

(Continued)

FOREIGN PATENT DOCUMENTS

| | | |
|---|---|---|
| FR | 2170904 | 9/1973 |
| GB | 1315762 | 5/1973 |
| WO | WO2012113384 | 8/2012 |

*Primary Examiner* — J. Gregory Pickett
*Assistant Examiner* — Niki M Eloshway
(74) *Attorney, Agent, or Firm* — Steven M. Greenberg, Esq.; Shutts & Bowen LLP

(57) ABSTRACT

A cap configured to close a container including a neck is disclosed herein. The cap includes at least one protruding element configured to cooperate with a slot situated on the neck such that the cap goes from a first position to a second position. The cap also includes at least one opening situated on an upper wall of the cap that is aligned with the at least one protruding element of the cap. The cap yet further includes a sealing element configured to impart sealing between the cap and the neck. The sealing element is radially offset relative to the protruding element.

13 Claims, 2 Drawing Sheets

(56) References Cited

U.S. PATENT DOCUMENTS

| | | | | |
|---|---|---|---|---|
| 4,795,043 | A * | 1/1989 | Odet | B65D 51/224 215/235 |
| 6,003,728 | A * | 12/1999 | Elliott | B65D 47/0804 206/219 |
| 6,446,823 | B2 * | 9/2002 | Miceli | B65D 41/06 215/222 |
| 7,021,477 | B2 * | 4/2006 | Wolfe | B65D 50/043 215/211 |
| 2001/0019033 | A1 * | 9/2001 | Montgomery | B65D 41/065 215/332 |
| 2002/0195412 | A1 | 12/2002 | Miceli et al. | |
| 2003/0024947 | A1 * | 2/2003 | Joshi | B65D 47/14 222/83 |
| 2005/0173436 | A1 * | 8/2005 | Amanat | B67B 7/00 220/258.4 |
| 2008/0073348 | A1 * | 3/2008 | Pritikin | B65D 47/142 220/278 |
| 2012/0187067 | A1 | 7/2012 | Maas et al. | |
| 2014/0190973 | A1 * | 7/2014 | Kerman | B65D 35/44 220/278 |
| 2016/0194122 | A1 | 7/2016 | Kerman et al. | |
| 2016/0278501 | A1 * | 9/2016 | Julien | B65D 51/225 |
| 2017/0297787 | A1 * | 10/2017 | Defert | B65D 41/0442 |
| 2017/0297788 | A1 * | 10/2017 | Defert | B65D 1/0246 |

* cited by examiner

PERFORATOR CAP, IN PARTICULAR FOR A FLEXIBLE TUBE

CROSS REFERENCE TO RELATED APPLICATIONS

This application claims priority under 35 U.S.C. § 119(a) to French Patent Application Serial Number 1655898, filed Jun. 23, 2016, the entire teachings of which are incorporated herein by reference.

BACKGROUND OF THE INVENTION

Field of the Invention

The present invention relates to the field of caps for containers.

Description of the Related Art

Traditionally, the caps are fastened on the opening of a container, such as a neck, by screwing. The cap and the neck are then provided with complementary screwing threads cooperating with one another. When the user wishes to close or open the container, he performs a screwing or unscrewing movement in one direction or the other and, after several revolutions, either the container is closed, or it is open.

Obtaining caps with a screwing thread nevertheless has drawbacks, in particular regarding stripping of the cap.

There is therefore a need for a cap was easier stripping.

SUMMARY OF THE INVENTION

To that end, the present invention proposes a cap configured to close a container including a neck. The cap includes:

- at least one protruding element configured to cooperate with a slot situated on the neck such that the cap goes from a first position, in particular open, to a second position, in particular closed,
- at least one opening situated on an upper wall of the cap, the opening(s) being aligned with the protruding elements of the cap,
- a sealing element configured to impart sealing between the cap and the neck, the sealing element being radially offset relative to the protruding element.

In other words, the cap according to the invention has no screwing thread. However, to allow the container to be opened or closed, the invention provides [at] least one protruding element that cooperates with a slot situated on the neck of the container.

Unlike the threads of the caps of the state of the art, the protruding element(s) of the cap according to the invention will be able to be obtained by molding above and below. In other words, part of the mold bearing the imprint of a first part of the cap comes from above and another part bearing the imprint of the rest of the cap comes from below. For this type of molding, the cap has at least one opening on its upper wall aligned with the protruding elements. The sealing with the container is then guaranteed despite the openings, by the sealing element positioned wisely.

A cap refers to an object making it possible to close the container sealably, in particular an outlet opening for a product, reversibly. A cap according to the invention can thus go from an open position to a closed position and vice versa, primarily through a screwing or equivalent movement. The present invention does not include the closing assemblies, such as a flip-top cap, fastened on the opening permanently and including a passage orifice for the product to exit and a foldable cover making it possible to close off the opening.

According to different embodiments of the invention, which may be considered together or separately:

- the cap goes from the open position to the closed position through a rotational and/or translational movement,
- the sealing element is situated on an inner surface of the upper wall,
- the protruding element(s) are situated on a peripheral inner surface of the cap, the slot(s) of the neck extending over an outer surface of the neck,
- the sealing element is situated radially withdrawn from the openings of the cap,
- the sealing element is a deformable element,
- the number of protruding elements of the cap, the number of openings of the cap and the number of slots of the neck are identical,
- the protruding element(s) of the cap are located on the lower part of the inner surface of the cap,
- the protruding element(s) of the cap are dimensioned so as to correspond to the width of the slot,
- the opening(s) of the cap are regularly distributed on the upper wall of the cap, the opening(s) of the cap are localized on the periphery of the upper wall,
- the protruding element(s) of the cap are regularly distributed on the perimeter of the inner surface of the cap,
- the sealing element is a sealing strip formed by an excess thicknesses of material on the inner surface of the upper wall of the cap,
- the sealing strip is configured to cooperate with a strip seat provided on an inner surface at the upper end of the neck when the cap is in the closed position,
- the cap further includes a punch suitable for cutting and/or piercing a membrane seal closing off an inner end of the neck emerging in an inner volume of the container,
- a base of the punch is surrounded by the sealing element,
- the punch is configured to be kept separated from the membrane seal in a waiting position,
- the cap is derived from molding,
- the cap is made in a single piece,
- the cap is made from plastic,
- the cap is made from thermoplastic material, such as a polyolefin, such as polypropylene, polyethylene, a copolymer thereof or a mixture thereof,
- the slot(s) extend over the outer surface of the neck from an upper end situated toward an outlet orifice of the neck to a lower end opposite the upper end of the neck,
- the slot(s) comprise at least one protruding element configured to cooperate with at least one of the protruding elements of the cap to keep the cap in the waiting position,
- the slot(s) are regularly distributed on the perimeter of the outer surface of the neck.

The invention also relates to an assembly for closing a container, the assembly including a neck and a cap as described above.

BRIEF DESCRIPTION OF THE DRAWINGS

Other features, aims and advantages of the invention will emerge from the following description, given purely as an illustration and non-limitingly, and which must be read in light of the appended drawings, in which.

Figure 1:
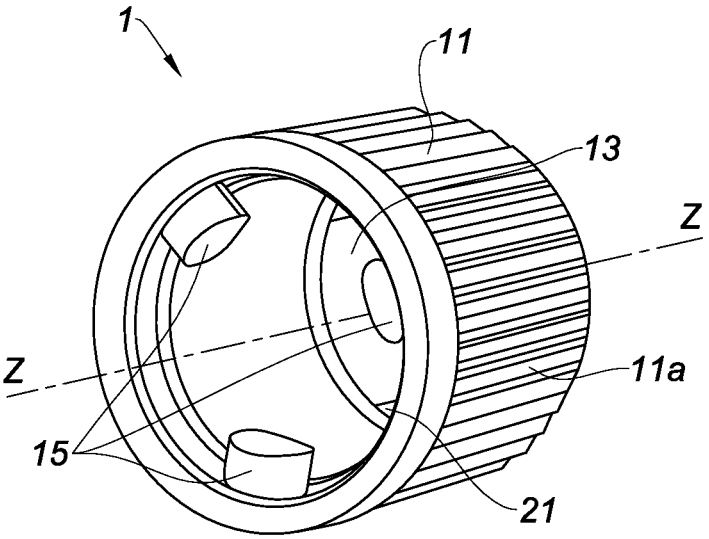
FIG. 1 is a perspective view of a cap according to a first embodiment of the invention.

In all of the figures, shared elements are identified using identical numerical references.

DETAILED DESCRIPTION OF THE EMBODIMENTS

As illustrated in the various figures, the invention relates to a cap 1 configured to close a container including a neck 3. The cap 1 is thus designed to be fastened on the neck 3 to close the container and to form an assembly including the neck 3 and the cap 1.

In the example illustrated here, the container is a tube 5 including a tube head 7 provided with the neck 3, defining a longitudinal axis Z-Z, and a shoulder 9.

In general, the cap 1 includes a peripheral wall 11 and an upper wall 13. A longitudinal direction of the cap 1 is defined, corresponding to the longitudinal axis Z-Z of the neck 3 when the cap 1 is fastened on the neck 3.

The outer surface of the peripheral wall 11 may be provided with longitudinal striations 11*a* so as to make the cap 1 easier to manipulate.

According to the invention, the cap, in particular the inner surface of its peripheral wall 11, has no screwing thread. However, at least one protruding element 15 is situated on this inner surface. The protruding element(s) 15 are configured to cooperate with a guide slot 17 extending over an outer surface of the neck 3 such that the cap 1 goes from an open position to a closed position, and vice versa.

Figure 2:
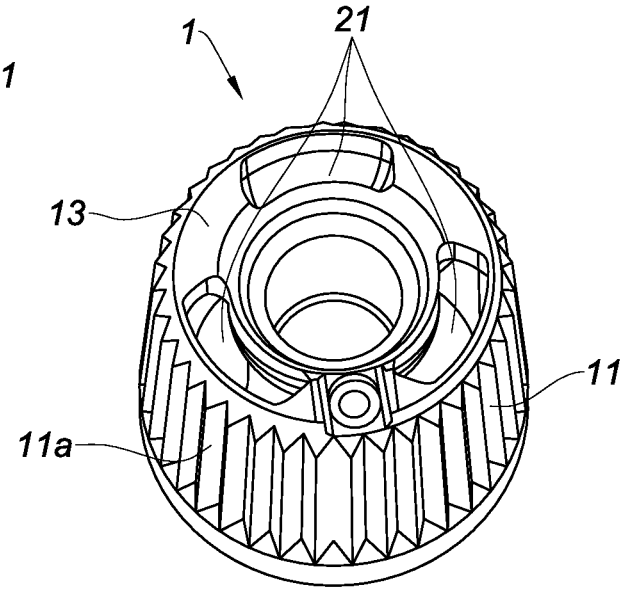
FIG. 2 is a perspective view of the top of the cap of FIG. 1.
Figure 3:
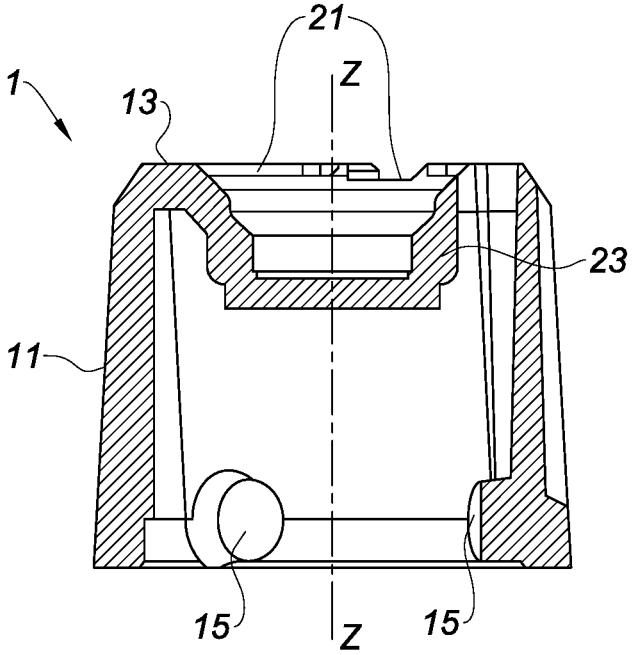
FIG. 3 is an axial sectional view of the cap of FIGS. 1 and 2.
Figure 4:
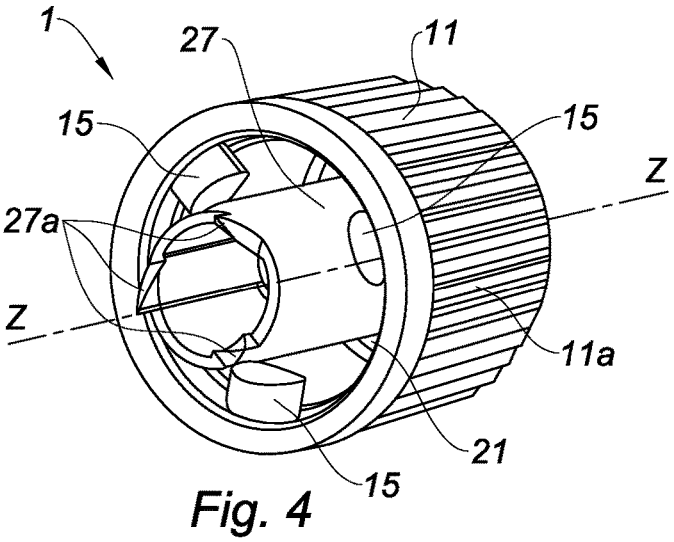
FIG. 4 is a perspective view of a cap including a punch according to a second embodiment of the invention.
Figure 5:
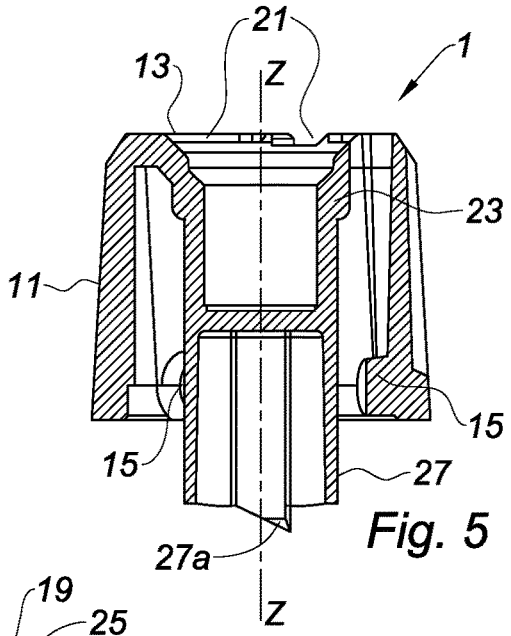
FIG. 5 is an axial sectional view of the cap of FIG. 4.

In the embodiment shown in FIGS. 1 to 3, the protruding elements of the cap 1 are three pins 15 regularly distributed over the perimeter of the bottom part of the cap 1. The diameter of the pins 15 is substantially similar to the width of the guide slot 17 to allow at least one of the pins 15, or all of the pins 15, to cooperate therewith.

Figure 6:
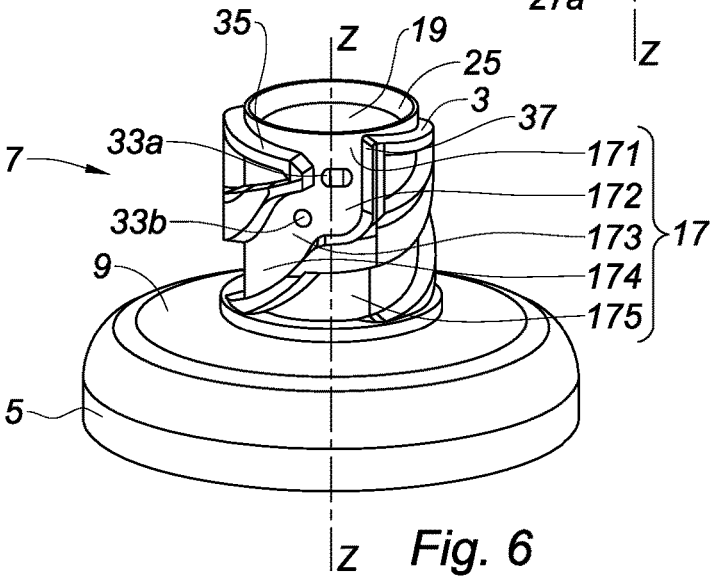
FIG. 6 is a perspective view of a partially illustrated container, including a neck for the caps of FIGS. 1 to 5.

The cap 1 shown in FIGS. 1 to 3 is designed to be fastened on the neck 3 shown in FIG. 6. In this embodiment, the neck 3 includes three slots 17 regularly distributed on the perimeter of the outer surface of the neck 3. The slots 17 extend over the outer surface of the neck 3 from an upper end situated toward an outlet orifice 19 of the neck 3 to a lower end opposite the upper end of the neck 3. The slots 17 in particular comprise an inlet 171 situated near the outlet orifice 19 of the neck 3. Each of the slots 17 extends between two edges 17*a*, extending radially from a bottom 17*b* of the slot 17.

Preferably, the number of slots 17 is identical to the number of protruding elements 15 of the cap 1.

Advantageously, to allow the cap 1 to go from an open position to a closed position and vice versa, the slot 17 has successive guide portions. This may in particular involve a first portion 172 ensuring the engagement of the corresponding protruding elements 15 in the slot 17 and/or the maintenance of the cap 1 in a waiting position (FIG. 7) and other successive portions 173, 174, 175 allowing the passage from the open position to the closed position (FIG. 8) and vice versa.

In the embodiment of the neck 3 shown in FIG. 6, the three slots 17 each have a first vertical portion 172 relative to the axis Z-Z. This first portion 172 in particular allows the engagement of the cap 1 in the slot 17, as well as its maintenance in the waiting position, in particular when the cap 1 includes a punch. This first portion 172 is followed by a second portion 173, which is helical with slope x, then by a third portion 174, which is helical with slope y. The slope y of the third helical portion 174 is greater than the slope x of the second helical portion 173. These two portions 173, 174 allow the cap 1 to go from the open and/or waiting position to the closed position, or from the closed position to the open position. The slot 17 lastly ends with a final portion 175 that is horizontal relative to the axis Z-Z. When the protruding elements 15 of the cap have reached this final portion 175, the cap 1 is in the closed position (FIG. 8) and the container is sealably closed.

This configuration of the slots 17 allows the user to switch the cap 1 from an open position to a closed position and vice versa through an essentially helical movement similar to that of a traditional cap provided with a screwing thread.

The cap 1 also includes three openings 21 situated on the upper wall 13 of the cap 1. The openings 21 are in particular located on the periphery of the upper wall 13 aligned with the protruding elements 15 of the cap 1 and are regularly distributed on the upper wall 13 of the cap 1.

The openings 21 correspond to the passage of a zone in the form of pins of part of the mold used to obtain an upper part of the protruding elements. Indeed, to manufacture a hollow object including at least one protruding element in its hollow part, such as the cap 1 according to the invention, the molding is for example done from above and below, i.e., part of the mold comes inside the object from above and another part comes inside from below the object. The opening 21 on the upper wall of the cap 1 thus allows the insertion of the upper part of the mold to form protruding elements 15.

Preferably, the number of openings 21 is identical to the number of protruding elements 15 of the cap 1.

Thus advantageously, the cap 1 derived from molding and is made from a plastic material, in particular a thermoplastic material, such as a polyolefin, such as polypropylene, polyethylene, a copolymer thereof or a mixture thereof.

Advantageously, the cap 1 is made in a single piece.

Figure 8:
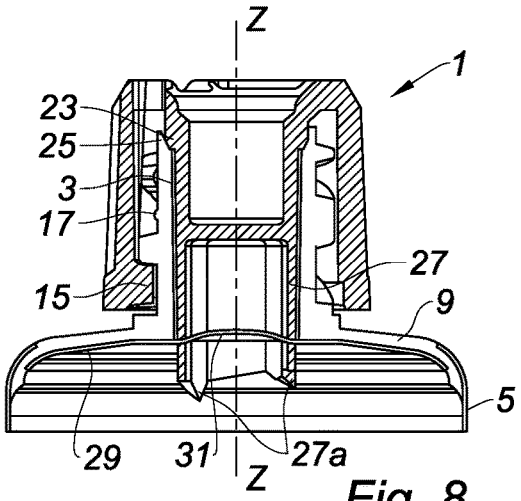
FIG. 8 is an axial sectional view of the container of FIG. 7, in which the cap is in the closed position.

To impart sealing between the cap 1 and the neck 3, and in particular to ensure the sealing of the tube 5 when the cap 1 is in the closed position, the cap 1 also includes a sealing element 23, in particular a deformable element. Here, the sealing element 23 is situated on an inner surface of the upper wall 13, radially withdrawn from the openings 21 of the cap 1. Here, this is an excess thicknesses of material on the inner surface of the upper wall of the cap 1, which corresponds to a sealing strip 23 situated radially withdrawn from the openings 21. The sealing strip 23 is configured to cooperate with a strip seat 25 provided on an inner surface at the upper end of the neck 3 when the cap 1 is in the closed position, as shown in FIG. 8. In other words, in the closed position, the strip 23 is compressed on the seat 25. The strip may comprise a deformable lip.

Advantageously, the number of protruding elements 15 of the cap 1, the number of openings 21 of the cap 1 and the number of slots 17 of the neck 3 are identical. In the embodiments illustrated here, the cap 1 includes three protruding elements 15 and three openings 21, and the neck 3 includes three guide slots 17.

In another embodiment, shown in FIGS. 4, 5, 7 and 8, the cap 1 includes the same elements as the cap of the preceding embodiments (FIGS. 1 to 3). In this embodiment, the cap 1 is also designed to be fastened on the neck 3 shown in FIG. 6. The cap 1 further includes a punch 27 protruding from the cap 1. The punch 27 is in particular derived from the material of the cap 1.

The punch 27 is in particular made up of material protruding from the inner face of the upper wall of the cap 1. An upper part of the punch 27 is thus surrounded by the peripheral wall 11 of the cap 1. The free end of the punch 27 is situated on the same side of the upper wall of the cap 1 as the protruding elements 15.

The punch 27 is configured so as to be inserted inside the neck 3 of the tube head 7 when the cap 1 is fastened on the neck 3.

Figure 7:
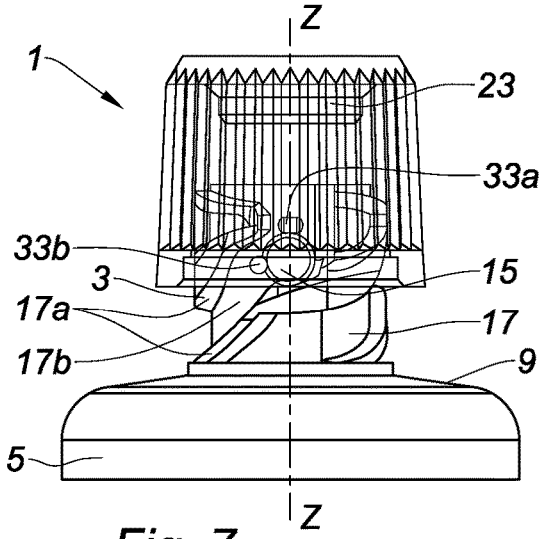
FIG. 7 is an elevation view of the container of FIG. 6, in which the cap of FIGS. 4 and 6 is in the waiting position.

The tube head 7 shown in FIGS. 7 and 8 further includes a solid insert 29 forming a membrane seal 31 closing off an inner end of the neck 3 emerging in an inner volume of the container, in the bottom part of the neck 3.

More specifically, the insert 29 includes a peripheral section, typically frustoconical or disc-shaped, and a central section forming the membrane seal 31, the diameter of which typically corresponds to the inner diameter of the neck 3.

The punch 27 allows the cutting and/or perforation of the membrane seal 31. The cutting is advantageously partial, such that the portion(s) of the membrane seal 31 having been cut remain connected to the rest of the insert 29, thus preventing any mixing of the material forming the insert 29 with a product contained in the associated container, and any distribution of this material to the user.

Here, the punch 27 has a cylindrical section of revolution, a free end of which is advantageously provided with cutting means such that when the cap 1 is fastened on the neck 3 of the container, the free end of the punch 27 is inserted into the neck 3. The cutting means can have a beveled shape at the free end thereof, teeth, and/or cutting notches, for example, regularly distributed on the perimeter of the free end of the punch 27. The example punch 27 shown in FIGS. 4, 5, 7 and 8 is a punch 27 with a cylindrical section of revolution, the free end of which is provided with three teeth 27*a* having a small height and regularly distributed over the perimeter of its free end.

The cap 1, and more particularly the punch 27, are configured such that a single and same essentially helical movement of the cap 1 is necessary to switch the cap 1 from an open position to a closed position, in order to insert the punch 27 inside the neck 3 and to pierce the membrane seal 31, during the first use.

In this embodiment, the slots 17 of the neck 3 advantageously comprise two protruding elements 33*a*, 33*b* configured to cooperate with one of the protruding elements 15 of the cap 1 to keep the cap 1 in the waiting position (FIG. 7), in which any punch 27 can be is kept separated from the membrane seal 31. This involves two lugs 33*a*, 33*b* situated on the outer surface of the neck 3 near the inlet 171 of the slot 17. More particularly, a first lug 33*a* is situated at the inlet 171 of the first portion of the slot 17. This lug 33*a* limits the upward axial movement along the axis Z-Z of the cap 1 and makes it possible to keep the cap 1 fastened on the neck 3 and to avoid any unwanted removal of the cap 1. The second lug 33*b* is situated between the first 172 and second 173 portions of the slot 17. It makes it possible to limit the rotational movement of the cap 1, and in particular the departure of the cap 1 from its waiting position and its engagement in a position where the membrane seal 31 would be perforated and/or cut. In other words, this second lug 33*b* makes it possible to keep the punch 27 separated from the membrane seal 31 and to avoid the perforation and/or cutting thereof without intervention by the user before the first use.

In this embodiment, the neck 3 advantageously includes a guide ramp 35, as shown in FIG. 6. The guide ramp 35 is configured to cooperate with at least one protruding element 15 of the cap 1 to position one of the protruding elements 15 at the inlet 171 of the slot 17. The guide ramp 35 makes it possible to guide one of the protruding elements 15 of the cap 1 in the first portion 172 of the guide slot 17. The guide ramp 35 is visible in FIG. 6.

Advantageously, the guide ramp 35 has a guiding direction opposite the guiding direction of the slot 17 for the passage of the cap 1 from the waiting position to the closed position. Thus, to position one of the protruding elements 15 of the cap 1 in the inlet of the slot 17, it is necessary to perform a rotational movement in one direction. This rotational movement is generally done by a machine, automatically. Then, once the cap 1 is placed in the waiting position, it is necessary to perform a rotational movement in the opposite direction, generally in the traditional direction of rotation to close a cap 1, which is most often in the clockwise direction, to remove the cap 1 from the waiting position and begin closing the cap 1 and/or the cutting and/or perforation of the membrane seal 31 by the punch 27. This dual rotation direction makes it possible to prevent the machine, during the placement of a cap 1 provided with a punch 27 in the waiting position, from performing an excessive rotation and priming the usage position in which the membrane seal 31 is cut and/or perforated and the punch 27 damages the membrane seal before use of the tube 5.

Advantageously, the ramp 35 can also comprise a stop to force one of the protruding elements 15 of the cap 1 to stop at the inlet of the slot 17. Here, the stop is an extension 37 of the first portion of the slot 17 toward the orifice of the neck 3.

The sealing element 23 here is made by an overthickness of material, annular, of the base of the punch 27.

The upper wall may be topped by other parts of the cap, while retaining its orientation transverse to the axis Z-Z.

What is claimed is:

1. A cap configured to close a container comprising a neck, the cap comprising:

at least one protruding element configured to cooperate with a slot situated on the neck such that the cap goes from a first position to a second position, at least one opening situated on an upper wall of the cap, the upper wall of the cap hermetically closing the container, the at least one opening being aligned with the protruding elements of the cap, the upper wall of the cap remaining at a distance from the neck when the cap is in the second position, a peripheral wall surrounding the neck, a sealing element configured to impart sealing between the cap and the container, the sealing element being radially offset relative to the protruding element, and a punch suitable for cutting and/or piercing a membrane seal closing off an inner end of the neck emerging in an inner volume of the container, the sealing element consisting of an annular over-thickness of the material of a base of the punch situated on an inner surface of the upper wall, the sealing element being configured to cooperate with a strip seat provided on an inner surface at the upper end of the neck when the cap is in the second position, the punch being configured to cut and/or pierce the membrane by a rotational movement of the cap.

2. The cap according to claim 1, wherein the sealing element is situated on an inner surface of the upper wall.

3. The cap according to claim 1, wherein the at least one protruding element is situated on a peripheral inner surface of the cap, the slot of the neck extending over an outer surface of the neck, the sealing element is situated radially withdrawn from the openings of the cap to ensure the sealing of the container.

4. The cap according to claim 3, wherein the number of protruding elements of the cap, the number of openings of the cap and the number of slots of the neck are identical.

5. The cap according to claim 1, wherein the at least one protruding element of the cap is located on the lower part of the inner surface of the cap.

6. The cap according to claim 1, wherein the at least one protruding element of the cap is dimensioned so as to correspond to the width of the slot.

7. The cap according to claim 1, wherein the at least one opening of the cap is regularly distributed on the upper wall of the cap.

8. The cap according to claim 1, wherein the at least one opening of the cap is localized on the periphery of the upper wall.

9. The cap according to claim 1, wherein the at least one protruding element of the cap is regularly distributed on the perimeter of the inner surface of the cap.

10. The cap according to claim 1, wherein the sealing element is a sealing strip formed by an excess thicknesses of material on the inner surface of the upper wall of the cap.

11. The cap according to claim 10, wherein the sealing strip is configured to cooperate with a strip seat provided on an inner surface at the upper end of the neck when the cap is in the second position.

12. The cap according to claim 1, configured so that the punch is kept separated from the membrane seal in a waiting position.

13. An assembly for closing a container, the assembly comprising:

a neck; and a cap configured to close a container comprising a neck, the cap comprising:

at least one opening situated on an upper wall of the cap, the upper wall of the cap hermetically closing the container, the at least one opening being aligned with the protruding elements of the cap, the upper wall of the cap remaining at a distance from the neck when the cap is in the second position, a peripheral wall surrounding the neck, a sealing element configured to impart sealing between the cap and the container, the sealing element being radially offset relative to the protruding element, and a punch suitable for cutting and/or piercing a membrane seal closing off an inner end of the neck emerging in an inner volume of the container, the sealing element consisting of an annular over-thickness of the material of a base of the punch, the sealing element being configured to cooperate with a strip seat provided on an inner surface at the upper end of the neck when the cap is in the second position, the punch being configured to cut and/or pierce the membrane by a rotational movement of the cap.

* * * * *